US005610474A

United States Patent [19]

Lagger et al.

[11] Patent Number: 5,610,474

[45] Date of Patent: Mar. 11, 1997

[54] PICTURE TUBE HAVING CENTERING WASHER AND SPRING FOR JOINING A MASK/FRAME INSIDE A SHIELDING CASE

[75] Inventors: Heinz Lagger, Wendlingen; Rolf Reidinger, Ebersbach; Werner Wolffram, Kirchheim/Nabern, all of Germany

[73] Assignee: Nokia Technology GmbH, Pforzheim, Germany

[21] Appl. No.: 324,534

[22] Filed: Oct. 18, 1994

Related U.S. Application Data

[63] Continuation of Ser. No. 29,449, Mar. 11, 1993, abandoned.

[30] Foreign Application Priority Data

Mar. 16, 1992 [DE] Germany ..... 42 08 319.2

[51] Int. Cl.[6] ..... H01J 29/07

[52] U.S. Cl. ..... 313/406; 313/405; 313/407

[58] Field of Search ..... 313/402, 404, 313/405, 406, 407

[56] References Cited

U.S. PATENT DOCUMENTS

| | | | |
|---|---|---|---|
| 4,358,702 | 11/1982 | Gijrath et al. | 313/404 |
| 4,467,242 | 8/1984 | Wilbur, Jr. et al. | 313/407 |
| 4,812,704 | 3/1989 | Van der Ven | 313/402 |
| 4,963,786 | 10/1990 | Tokita et al. | 313/407 |
| 5,003,218 | 3/1991 | Gijrath et al. | 313/407 |

FOREIGN PATENT DOCUMENTS

| | | | |
|---|---|---|---|
| 63-10436 | 1/1988 | Japan | 313/406 |

*Primary Examiner*—Sandra L. O'Shea
*Assistant Examiner*—Matthew J. Esserman
*Attorney, Agent, or Firm*—Ware, Fressola, Van Der Sluys & Adolphson

[57] ABSTRACT

According to the prior art, springs (11/18) of a combination mask/frame (10) of picture tubes are joined to the frame by resistance welding. This welding technique is also customary when one of the springs (18) has a centering washer (20) at its free end. When combination mask/frames (10) designed in this manner are snapped repeatedly into and out of the shielding case (15), and when the shielding case (15) is stabilized or fritted to the neck of the picture tube, it can happen that the expansion characteristics of the combination mask/frame (10) are not homogeneous at the fourth spring (18) as compared to the other springs (11) under the picture tube's operating conditions. According to the invention, the centering washer (20) is joined to the spring (18) by laser welding, with laser beams (24) striking the side of the spring (18) facing the frame (10) from the inside (22) of the combination mask/frame (10), and joining the welding grooves (25) arranged in the spring (18) at their edges (26) to the centering washer (20).

9 Claims, 4 Drawing Sheets

PICTURE TUBE HAVING CENTERING WASHER AND SPRING FOR JOINING A MASK/FRAME INSIDE A SHIELDING CASE

This is a continuation of application Ser. No. 08/029,449 filed on Mar. 11, 1993, now abandoned.

TECHNICAL FIELD

The invention concerns an improvement in the quality of combination mask/frames of picture tubes, especially the joining of centering washers to springs.

BACKGROUND OF THE INVENTION

Shadow masks of picture tubes are usually surrounded by a frame. This combination mask/frame is set in the shielding case of the picture tube. The joint between shielding case and combination mask/frame is implemented by means of "pins", set in the shielding case, the free ends of which contact the free ends of springs attached to the outer contour of the frame in such a way that a portion of the length of the pins projects through an opening arranged in each spring. The other ends of the springs, which are bent at an angle but run essentially parallel to the contour of the frame, are welded to the frame. Usually a bimetallic retainer is interposed between the welded end and the frame in order to compensate for thermal expansion during operation of the picture tube.

To obtain good reproducibility in the position of the combination mask/frame when the combination mask/frame is snapped in and out, essentially two procedures have emerged in the prior art:

In the first procedure, three of the four springs are welded onto the frame and onto the bimetallic retainers, and the combination mask/frame is set in the shielding case by means of the three springs. Then the opening of the fourth spring is set on the free end of the pin, and the end to be attached to the frame is snapped into place behind a hook located on the bimetallic retainer. The spring that snaps into place behind the hook is then joined to the bimetallic retainer by resistance welding.

According to the other procedure, the three springs already described above are again welded to the frame and to the bimetallic retainers. In addition, during this procedure the fourth spring is also resistance-welded to the bimetallic retainer. This fourth spring has an opening that is larger than the openings in the other three springs. When a combination mask/frame configured in this manner is then set in the shielding case, the combination mask/frame is held in the shielding case by the three springs having the smaller openings, which rest on the pins. After the combination mask/frame is snapped into place, the pin corresponding to the fourth spring, which has the larger opening, also projects through it. However, because of its larger opening cross section as compared to the openings of the other springs, this spring does not sit on the outer contour of the pin, but surrounds the pin at a distance. The free end of the spring is then bent towards the frame and a centering washer is slid onto the pin. This centering washer has an opening which corresponds, in terms of shape and dimension, to the openings of the three openings sitting on the outer contours of the pins. When the spring is then relaxed, the free end of the spring presses the centering washer against the pin. The result is that the fourth spring sits on the outer contour of the pin via the centering washer, and a portion of the length of the pin projects through the opening of the centering washer and the spring. In this state the spring is resistance-welded to the centering washer.

The latter method has the disadvantage that resistance welding causes spatters which burn into the glass of the shielding case and thus render the case unusable. The welding spatter problem also occurs with the first method. Also considered to be a disadvantage with the first method is the fact that in order to join the fourth spring to the frame and the bimetallic retainer, welding tongs must be applied to the frame for resistance welding. The frame can very easily be bent by the welding tongs, and can also be bent by thermal stresses in the frame and the spring as a result of the welding process. If combination mask/frames produced by the aforesaid procedures are subjected to closer examination, it is evident that the expansion characteristics of the combination mask/frames during operation of the picture tube are not the same at the fourth spring as at the other three springs. This may still be tolerable with smaller picture tube formats, but is no longer tolerable at larger formats with a mask/frame contour that has little curvature.

The underlying object of the invention is therefore to indicate a process for designing combination mask/frames that allows the production of combination mask/frames with uniform expansion characteristics.

SUMMARY OF THE INVENTION

This object is achieved by joining the centering washer to the spring by laser welding, with the laser beams, proceeding approximately from the center of the case, joining the edges of welding grooves, recessed in the fourth spring, to the centering washer. This manner of joining the centering washer and spring ensures that the two parts are joined to one another in a stress-free manner. A combination mask/frame designed in this manner, when it is snapped in or out or when the tube is fritted together with the shielding case, consequently does not exhibit the expansion in the region of the welds that is otherwise common (i.e., when the conventional method is used). Secure attachment of the centering washer on the spring is ensured by the fact that the centering washer is welded to the edges of welding grooves arranged in the spring.

If three welding grooves surround the opening of the fourth spring in a star pattern, this not only guarantees good joint strength, but also ensures that the laser beam can be guided from the center of the case directly to each welding point without having the frame itself present obstacles. A good joint between spring and centering washer is achieved if the welding grooves in the spring correspond to the inclination of the laser beam striking the spring.

BEST MODE FOR CARRYING OUT THE INVENTION

Figure 1:
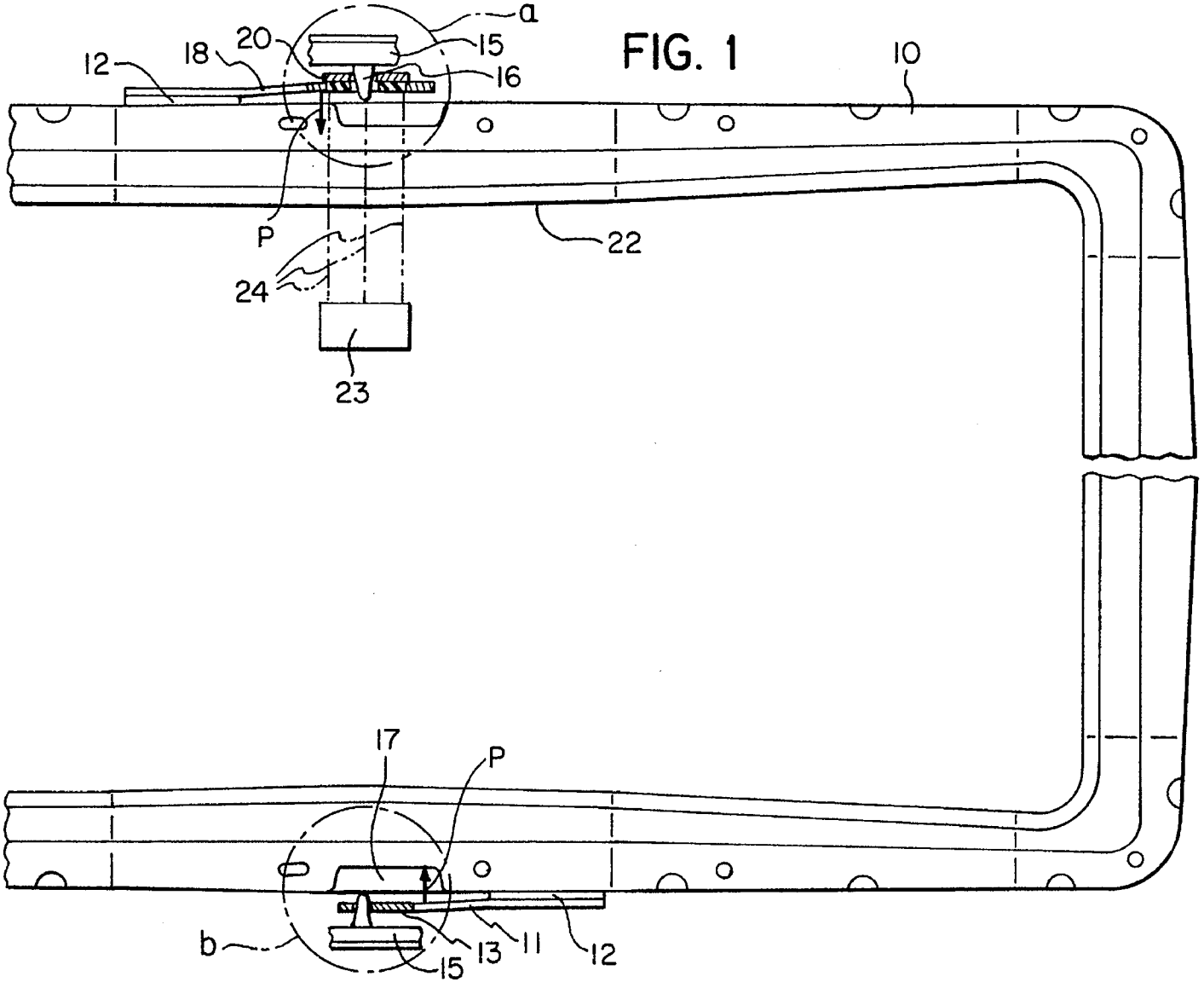
FIG. 1 shows a portion of a top view of a mask/frame.
Figure 1A:
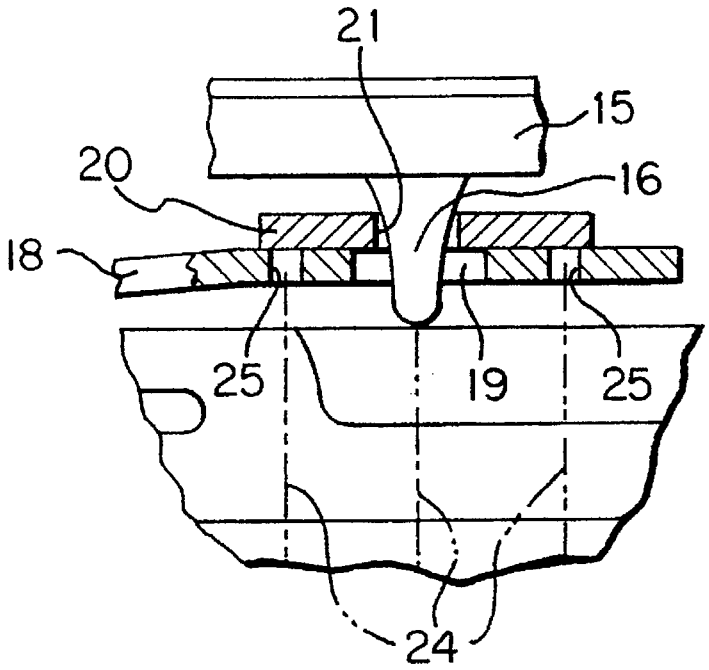
FIG. 1*a* shows an exploded view of an area circled and labelled "a" in FIG. 1.
Figure 1B:
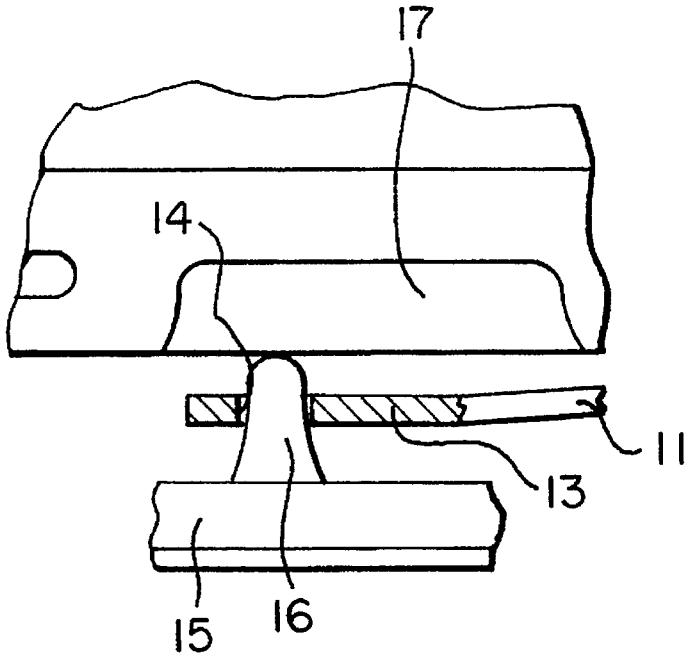
FIG. 1*b* shows an exploded view of an area circled and labelled "b" FIG. 1.
Figure 2:
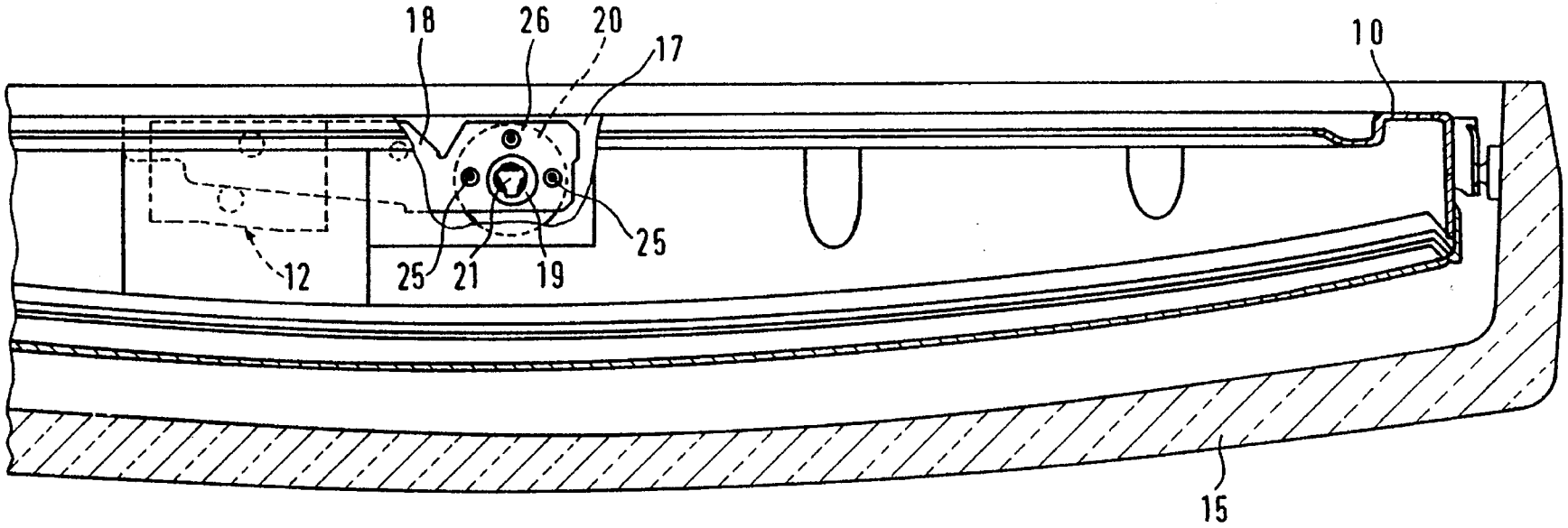
FIG. 2 shows a side view of a section through a combination mask/frame that is set in a shielding case.

FIGS. 1*a* and 1*b* show a portion of a mask/frame 10. The lower half of FIGS. 1*a* and 1*b* show one of three springs 11, whose fixed end is welded onto a bimetallic retainer 12. The bimetallic retainer 12 is in turn welded onto the outer contour of the mask/frame 10. As this Figure clearly illustrates, the spring 11 has a shape that is bent down but nonetheless runs essentially parallel to the frame 10. The free end 13 of the spring 11 has an opening 14. A pin 16 is set into a shielding case 15. This pin 16 projects through the opening 14 of the spring 11. The shapes of the pin 16 and the opening 14 are matched to one another in such a way that the opening 14 of the spring 11 sits on the outer contour of the pin 16 at half the pin's length. In order to set the spring 11 on the pin 16, the spring 11 is bent in the direction of arrow P. To allow deflection of the spring 11 in the direction of the arrow, recesses 17 are provided in the frame 10. The combination mask/frame 10 is set in the shielding case 15 by means of three of these spring arrangements shown in the lower half of FIGS. 1, 1*a* and 1*b*. At this same time, the fourth spring 18 shown in the top half of FIG. 1, which essentially corresponds to the shape of the other springs 11, is also joined to the frame 10 at the bimetallic retainer 12. As FIG. 2 shows, the fourth spring 18 differs from the springs 11 in that it has an opening 19 that is larger than the opening 14. The result of this enlarged opening 19 is that when the spring 18 is bent in the direction of arrow P into the recess 17 in order to snap the combination mask/frame into place, after the spring 18 is relaxed it does not sit on the outer contour of the pin 16 that is shown in FIGS. 1, 1*a* and 1*b*, and set in the shielding case 15, but rather surrounds the pin 16 at a distance. The spring 18 is then moved in the direction of arrow P into the recess 17, the centering washer 20 is slid onto the pin 16, and the spring 18 is relaxed, so that under the action of the spring pressure, the centering washer is pressed against the outer contour of the pin 16. Since the opening 21 in the centering washer 20 corresponds in shape and dimension to the opening 14 in the springs 11, here again the pin 16, at the point of contact with the opening 21 on the outer contour, projects for half its length through the opening 21.

In another exemplary embodiment (not illustrated), the centering washer 20 can also already be slid onto the pin 16 when the mask 10, with all its springs 11, 18, is snapped into the shielding case 15 for the first time.

If the centering washer 20 is arranged between the spring 18 and the shielding case 15, laser welding of the centering washer 20 and spring 18 occurs from the inside 22 of the mask. This is shown schematically in FIGS. 1, 1*a* and 1*b*. The laser arrangement 23, which is arranged on the inside 22 of the mask, is located (with reference to the orientation of the drawing) above the plane of the mask/frame 10, so that the laser beams 24 can strike the side of the spring 18 facing the frame 10 without obstruction, i.e. without interference from the frame 10. To ensure a good joint between the spring 18 and the centering washer 20 with the use of the laser welding technique, the spring 18' has welding grooves 25. These welding grooves 25 are present at the points at which the laser beams 24 strike the spring 18. In the present exemplary embodiment shown in FIG. 2 the welding grooves 25 are arranged in a star pattern around the opening 19. When the laser beams 24 strike the welding grooves 25, the edges 26 of the welding grooves 25 are joined to the centering washer 20 without creating stresses in the spring 18 or the centering washer 20. For these reasons, subsequent mechanical or thermal stresses can now be exerted on the combination mask/frame 10 without critical consequences, since these processes are not accompanied by relaxation of the stresses that would otherwise be observed during welding.

Figure 3:
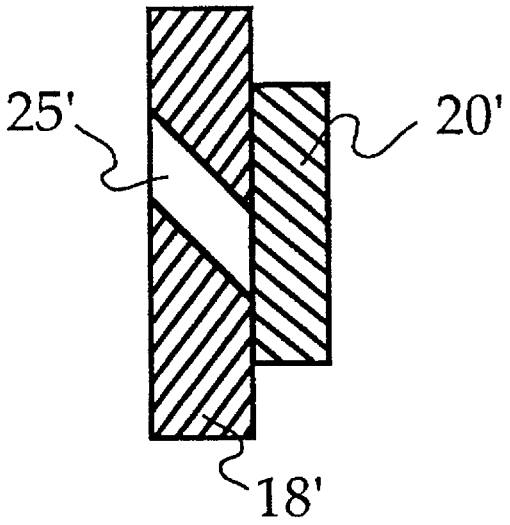
FIG. 3 shows an alternative embodiment of the invention shown in FIGS. 1–2.

FIG. 3 shows an alternative embodiment of the invention shown in FIGS. 1–2, in which the welding grooves 25' in the fourth spring 18' are inclined at an angle with respect to the surface of the fourth spring (18'). As shown in FIG. 1, the welding grooves (25) in the fourth spring (18) have an axis that is substantially perpendicular with respect to the surface of the fourth spring (18). As shown in FIG. 3, the welding grooves (25') in the fourth spring (18') have an axis that is substantially inclined at an angle with respect to the surface of the fourth spring (18').

We claim:

1. A combination mask/frame for picture tubes, with a frame;

with bimetallic retainers that are being welded to the frame;

with three springs, bent downward but running essentially parallel to the frame contour, the fixed ends of which are welded to the bimetallic retainers and the free ends of which have openings whose inside diameter is essentially dimensioned so that when the springs are pressed against the pins set in the rim of the shielding case, these openings sit on points on the outer contour of the pins that are at a distance from the rim of the shielding case, with a fourth spring, also bent downward and running essentially parallel to the frame contour, the fixed end of which is welded to the bimetallic retainer and the free end of which has an opening larger than the other openings;

with a centering washer that has an opening that corresponds in shape and diameter to the openings of the other three springs and is joined to the side of the spring which faces the rim of the shielding case in such a way that the region of the centering washer that surrounds the opening covers the opening in the spring, characterized in that the fourth spring (18) has welding grooves (25) that pierce the free end, and the welding grooves (25) have welding edges (26) at the ends of the welding grooves (25) for connecting the fourth spring (18) to the centering washer (20) by laser beams (24) that pass through the welding grooves 25.

2. A combination mask/frame according to claim 1, characterized in that the welding grooves (25) are arranged around the opening (19) in the fourth spring (18) in a star pattern.

3. A combination mask/frame according to claim 2, characterized in that the welding grooves (25) in the fourth spring (18) are inclined at an angle other than 90° with respect to the surface of the fourth spring (18).

4. A combination mask/frame according to claim 1, characterized in that the welding grooves (25) in the fourth spring (18) are inclined at an angle other than 90° with respect to the surface of the fourth spring (18).

5. A combination mask/frame according to claim 2, characterized in that the welding grooves (25) in the fourth spring (18) have an axis that is substantially perpendicular with respect to the surface of the fourth spring (18).

6. A combination mask/frame according to claim 2, characterized in that the welding grooves (25) in the fourth spring (18) have an axis that is substantially inclined at an angle other than 90° with respect to the surface of the fourth spring (18).

7. Apparatus for joining a mask/frame (10) to a shielding casing (15) for a picture tube, comprising:

a shielding casing (15) having a rim with pins (16) arranged therein, each pin (16) having an outer contour;

a mask/frame (10) having a contour;

three bimetallic retainers (12) each being welded to the mask/frame (10);

three springs (11), being bent downward and arranged substantially parallel to the contour of the frame, each having a fixed end being welded to an associated one of the bimetallic retainers (12) and having a free end (13) with an opening (14), each opening (14) having an inside diameter being substantially dimensioned so that a periphery of the opening (14) of each spring (11) is pressed against the outer contour of each pin (16) and each spring (11) rests at a predetermined distance away from the rim of the shielding case (15);

a fourth bimetallic retainer (12) also being welded to the mask/frame (10);

a fourth spring (18) also being bent downward and arranged substantially parallel to the contour of the frame (10), having a fixed end that is welded to the fourth bimetallic retainer (12) and having a free end (13) with a larger opening (19) than the openings of the three springs (11), and having at least one laser welding groove (25) piercing the free end and arranged around the larger opening (19); and a centering washer (20) being arranged between the free end of the fourth spring (18) and the rim of the shielding case (15), having a centering opening that substantially corresponds in shape and diameter to the openings (14) of the three springs (11), the centering washer (20) having a region that surrounds the centering opening for covering a part of the larger opening (19) in the fourth spring (18), and the centering washer (20) and the free end of the fourth spring (18) being joined by welding groove edges (26) which each correspond to a respective one of said at least one laser welding groove (25), said welding groove edges (26) being welded by heat from a laser beam (24) passing through the at least one laser welding groove (25) and striking the fourth spring (18) and centering washer (20);

whereby the centering washer (20) and the fourth spring (18) are joined in a stress-free manner.

8. Apparatus according to claim 7, wherein said at least one laser welding groove (25) includes three welding grooves (25) which are arranged around the opening (19) in the fourth spring (18) in a star pattern.

9. Apparatus according to claim 8, wherein the three laser welding grooves (25) in the fourth spring (18) are inclined at an angle other then 90° that substantially corresponds to the angle of inclination of the laser beams (24, 24') with respect to the surface of the fourth spring (18).

* * * * *